US006345563B1

(12) United States Patent
Middione et al.

(10) Patent No.: US 6,345,563 B1
(45) Date of Patent: Feb. 12, 2002

(54) REACTIVE PILL ARMOR

(75) Inventors: Mark Albert Middione, Scotts Valley; Paul Singh, Fremont, both of CA (US)

(73) Assignee: United Defense, L.P., Arlington, VA (US)

( * ) Notice: Subject to any disclaimer, the term of this patent is extended or adjusted under 35 U.S.C. 154(b) by 0 days.

(21) Appl. No.: 09/607,673

(22) Filed: Jun. 30, 2000

(51) Int. Cl.[7] ..... F41H 11/00
(52) U.S. Cl. ..... 89/36.17
(58) Field of Search ..... 89/36.02, 36.08, 89/36.17

(56) References Cited

U.S. PATENT DOCUMENTS 3,736,838 A * 6/1973 Butterweck et al.
4,398,446 A * 8/1983 Pagano et al.
4,965,138 A * 10/1990 Gonzalez
5,014,593 A * 5/1991 Auyer et al.
5,221,807 A * 6/1993 Vives
5,370,034 A * 12/1994 Turner et al.
5,686,689 A * 11/1997 Snedeker et al.
6,200,664 B1 * 3/2001 Figge et al.

FOREIGN PATENT DOCUMENTS

DE 2053345 A1 * 2/1977
FR 2498312 * 1/1982
GB 2192697 A * 1/1988

* cited by examiner

*Primary Examiner*—Michael J. Carone
*Assistant Examiner*—Troy Chambers
(74) *Attorney, Agent, or Firm*—Ronald C. Kamp

(57) ABSTRACT

An improved reactive armor system having one or more layers of matrix plates, each plate having a plurality of shallow wells with a plurality of blind holes in each well and an explosive pill in each blind hole. An explosive sheet covers each well and is in close proximity to the pills in the associated wells to insure that all the pills within a well will detonate when one pill therein is detonated. A separation plate covering and held in engagement with each matrix plate isolates each well from the other wells.

7 Claims, 1 Drawing Sheet

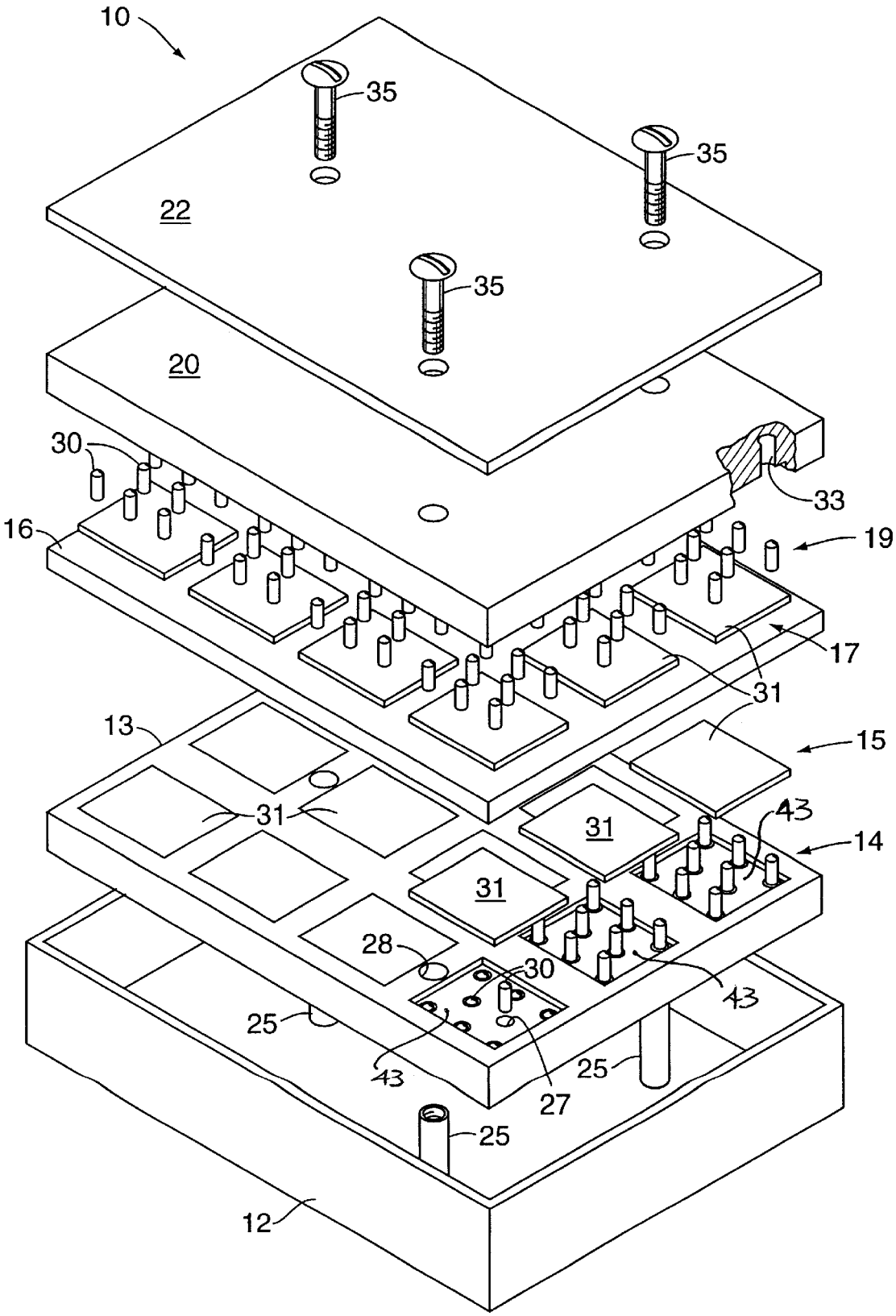
10
35
35
35
22
20
30
33
16
19
17
31
13
15
31
31
43
14
28
30
43
25
43
27
25
25
12

REACTIVE PILL ARMOR

BACKGROUND OF THE INVENTION

The present invention relates generally to reactive armor, and more particularly, to such armor that can resist multiple hits from projectiles.

In the prior art, armor for the roof of military vehicles was unable to defeat bomblet type or other multi-hit threats or, if such armor was able to do so, was so heavy that it adversely affected vehicle performance. Such prior art armor had limited resistance to shaped charges, especially when they approach perpendicularly to the surface of the armor. In addition, such armor provided little protection against nuclear radiation.

SUMMARY OF THE INVENTION

It is an object of the invention to provide an armor that is able to defeat bomblet type or other multi-hit shaped charge threats.

It is also an object of the invention to provide an armor that is capable of defeating a shaped charge projectile regardless of the angle of attack of such projectile.

It is another object of the invention to provide a lighter and more efficient reactive armor.

It is another object of the invention to provide an armor with improved protection from nuclear radiation resulting from battlefield nuclear events.

The invention provides a unique configuration of layers of explosives in a polymer material which provides an improved reactive armor capable of defeating perpendicularly directed threats, including shaped charges. Since the polymer material also possesses the attribute of absorbing certain types of nuclear radiation, the armor of the present invention provides improved protection against the deleterious effects such radiation can have on the crew of, and electronic equipment carried within, the vehicle. The matrix material also provides improved ballistic resistance to fragments of artillery projectiles, as well as to kinetic energy types of armor piercing ammunition.

BRIEF DESCRIPTION OF THE DRAWINGS

The sole FIGURE is an isometric, expanded view of a preferred embodiment of the invention.

DESCRIPTION OF THE PREFERRED EMBODIMENTS

A preferred embodiment of the present invention is illustrated in the drawing, wherein the reactive armor system, indicated generally at 10, comprises a open-faced box 12, a first matrix plate 13, a first layer of explosive pills 14, a first layer of explosive sheets 15, a separation plate 16, a second layer of explosive sheets 17, a second layer of explosive pills 19, a second matrix plate 20, and a cover plate 22. Such a reactive armor system 10 may be mounted on the outer surface of a military vehicle, such as a tank or armored personnel carrier.

The box 12 is made of steel, titanium, composite, or other strong material, and forms five sides of the box 12 leaving an open side. The bottom of the box 12 is the side of the box with the largest surface area, and a plurality of pass through tubes 25, made of a similar material, is attached thereto. The first matrix plate 13, is made of a polymer, or composite material, and is a flat plate with a first or inner side and a second or outer side. The first matrix plate 13 fits inside the box 12, with its inner side adjacent to and substantially covering the bottom of the box 12. A plurality of shallow wells or recesses 43 is formed in the outer or second side of the matrix plate 13 with a plurality of blind holes 27 bored into each well 43. A plurality of apertures 28 extend through the first matrix plate 13, and are positioned to avoid the wells 43 and to accommodate the pass through tubes 25.

Explosive pills 30 are placed in the holes 27 in the second side of the first matrix plate 13, forming the first layer of explosive pills 14. The explosives pills 30 are formed separately into pellets which are then pressed into the holes 27 or are cast in paste form directly into the holes 27. An explosive sheet 31 covers each well 43, with the depth of the well being substantially equal to the thickness of the explosive sheet 31 so that the upper surface thereof is flush or even the outer surface of the second side of the first matrix plate 13. Each explosive sheet is thus in touch with or in close proximity to each of the pills in the associated well 43. The plurality of explosive sheets 31 form a first layer of explosive sheets 15. The inner or first side of a separation plate 16 covers the first layer of explosive sheets 15 and contacts the second side of the first matrix plate 13 and thereby serves to isolate the wells from each other. In the preferred embodiment, the separation plate 16 is made of a composite material, and is provide with a plurality of apertures positioned to accommodate the pass through tubes 25.

The second matrix plate 20 is a mirror image of the first matrix plate 13 and is positioned with its inner or first side in engagement with the outer or second side of the separation plate and with a plurality of explosives sheets 31 positioned in complementary shallow wells formed in the inner or first side of the second matrix plate 20. Each of the plurality of blind holes 33 in each of the shallow wells contains an explosive pill 30. The plurality of explosive sheets 31 are made of the same material as the explosive sheets 31 of the first layer of explosive sheets 15, and forms a second layer of explosive sheets 17 with the plurality of explosive pills 30 forming a second layer of explosive pills 19. The second matrix plate 20 may be made of the same lightweight material as used to make the first matrix plate 13. A plurality of apertures extend through the second matrix plate 20 positioned to avoid the wells formed therein and to accommodate the pass through tubes 25. The cover plate 22 abuts the outer or second side of the second matrix plate 20 and is provided with similar apertures to mate with the pass through tubes 25. A threaded bolt 35 extends through each of the pass through tubes 25 to engage a threaded hole in the hull of the vehicle to draw the components of the armor system tightly together and to mount the assembled reactive armor system 10 thereon.

A shaped charge will upon impact detonate and create a stream of metal directed towards the hull of the vehicle, which stream will first pierce the cover plate 22 and the second matrix plate 20 initially causing one of the explosive pills 30 to detonate. The detonation of even one the explosive pills 30 within a well 43 will detonate the explosive sheet 31 for that particular well which in turn will detonate all of the explosive pills within that particular well. The resultant multiplicity of explosions will deflect or otherwise interrupt the stream of metal produced by the shaped charge. The separation plate 16 having its outer or second side in tight engagement with the inner or first side of the matrix plate 20 will isolate the other wells preventing detonation of the explosive sheets and pills associated with such other wells. Thus, each of the remaining wells retains the ability of defeating other similar threats, thereby preserving the armor system's desired multi-hit capability.

The use of lightweight materials such as composites and polymers for the matrix plates and the separation plate allows the assembled armor system 10 to be relatively light in weight, while the explosive pill and explosive sheet configuration allows the lightweight armor to defeat shaped charges. The ability to stack layers allows customization in order to protect against larger threats. Because this inventive armor system has the capability to protect against shaped charges directed more or less perpendicularly to the surface, it is adaptable for use on the front and sides of a tank for protection against antitank guided missiles, or for use on the bottom of a tank for protection against armor piercing mines, in addition to use as a top attack armor. While the armor system of this invention is especially useful on vehicles, could also be used for ballistic shelters, ship structures and bunkers where shaped charge threats exist. The explosive pills and sheets are made of an insensitive explosive, which only reacts to a shaped charge, and thus do not react to small arms, machine gun or medium cannon threats. The polymer material used to make the first and second matrix plates may be selected to provide nuclear radiation protection. Reference herein to a polymer material is intended to include either a pure polymer material or a polymer material that is reinforced with fibers or powders, such as fiberglass.

While preferred embodiments of the present invention have been shown and described herein, it will be appreciated that various changes and modifications may be made therein without departing from the spirit of the invention as defined by the scope of the appended claim.

What is claimed is:

1. An armor system for defeating an incoming projectile, comprising:

a first matrix plate having an outer side with a plurality of first shallow wells;

a plurality of first blind holes formed in each of said wells;

a first explosive pill positioned in each of said holes;

a first explosive sheet positioned in each well covering and in close proximity to all of the pills in the associated well; and a separation plate having an inner side covering said outer side of said first matrix plate, whereby an incoming projectile will cause the explosive sheet to detonate all of the pills within the associated well to disrupt said projectile, and said separation plate will confine the detonation of said pills to only those in the said associated well.

2. The armor system, as recited in claim 1, further comprising:

a box with an open side;

said first matrix plate being positioned inside the open box with its outer side facing said open side; and a cover secured to said box for closing said open side and thereby creating a modular unit.

3. The armor system, as recited in claim 1, and further comprising:

a second matrix plate having an inner side positioned with its inner side adjacent the outer side of said separation plate;

said inner side of said second matrix plate having a plurality of second shallow wells formed as a mirror image of said first wells in the outer side of said first matrix plate;

a plurality of second blind holes formed in each of said second wells;

a second explosive pill positioned in each of said second holes; and a second explosive sheet positioned in each of said second wells and contacting each of the second pills in said the associated second well.

4. The armor system, as recited in claim 3, wherein the first and second matrix plates are made of a polymer material.

5. A modular armor system for defeating a plurality of incoming projectiles, comprising a box having an open face;

a first matrix plate positioned within said box and having an outer surface with a plurality of first shallow wells formed therein;

a second matrix plate positioned within said box and having an inner surface with a plurality of second shallow wells formed therein as a mirror image of said first shallow wells;

a plurality of blind holes formed in each of the first and second wells;

an explosive pill positioned in each of the blind holes;

an explosive sheet positioned in each of the first and second wells covering and adjacent to all of the pills in the associated well;

a separation plate interposed between the outer surface of said first matrix plate and the inner surface of said second matrix plate; and a cover plate secured to said box covering said open face for holding said plates in tight engagement so that an incoming projectile will detonate at least one of the pills causing the explosive sheet adjacent said one pill to detonate, insuring that all of the pills in the well containing said one pill will also detonate and thereby disrupt the incoming projectile, and said separation plate will isolation said well containing said one pill from all of the other wells.

6. The invention according to claim 5 and further comprising:

a plurality of pass-through tubes secured to the box opposite said open face;

each of said plates having a plurality of registry holes equal in number to the number of said tubes and positioned to register therewith;

and removeable fasteners extending through said tubes to secure the plates in said box.

7. The invention according to claim 6, wherein said tubes are positioned so that none of said wells are intersected by said registry holes.

* * * * *